US006101645A

United States Patent [19]

Hill

[11] Patent Number: 6,101,645

[45] Date of Patent: Aug. 15, 2000

[54] METHOD OF MAKING DECORATIVE JERSEY SQUARES FROM RECYCLED SPORTS JERSEYS

[76] Inventor: Barbara K. Hill, 18020 San Fernando Mission Blvd., Granada Hills, Calif. 91344

[21] Appl. No.: 09/097,380

[22] Filed: Jun. 15, 1998

Related U.S. Application Data

[63] Continuation-in-part of application No. 08/820,410, Mar. 12, 1997.

[51] Int. Cl.[7] ..... A47G 9/00

[52] U.S. Cl. ..... 5/502; 5/482

[58] Field of Search ..... 223/2; 112/117, 112/118, 440; 442/242, 275, 327; 156/92, 93; 5/482, 502, 500

[56] References Cited

U.S. PATENT DOCUMENTS

| | | | |
|---|---|---|---|
| 4,426,945 | 1/1984 | A-Yan | 112/440 |
| 5,249,323 | 10/1993 | Kikuchi et al. | 5/502 |
| 5,459,895 | 10/1995 | Kikuchi et al. | 5/502 |
| 5,483,713 | 1/1996 | Kikuchi et al. | 5/502 |

*Primary Examiner*—Terry Lee Melius
*Assistant Examiner*—Fredrick Conley
*Attorney, Agent, or Firm*—Richard D. Slehofer

[57] ABSTRACT

A method of making a quilt through decorative jersey squares constructed from recycled sports jersey.

3 Claims, 2 Drawing Sheets

FIG. 3
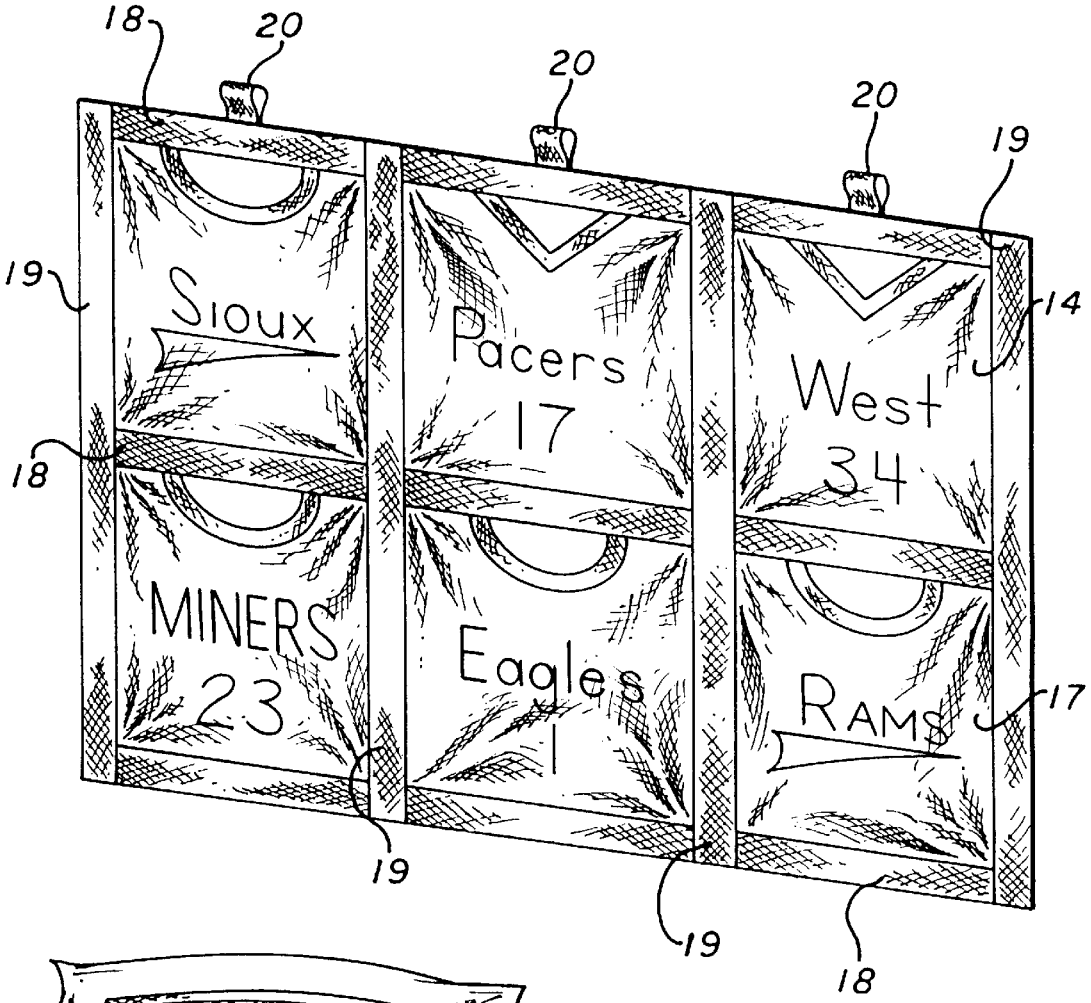
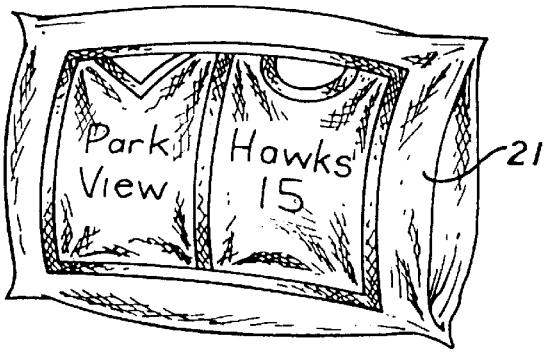
FIG. 4
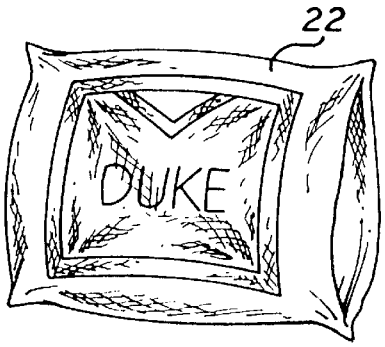
FIG. 5

METHOD OF MAKING DECORATIVE JERSEY SQUARES FROM RECYCLED SPORTS JERSEYS

CROSS REFERENCE TO RELATED APPLICATIONS

This is a continuation-in-part of application Ser. No. 08/820,410 filed on Mar. 12, 1997, and which is currently pending.

BACKGROUND-FIELD OF INVENTION

This invention relates to a method of making decorative jersey squares from recycled sports jerseys for attachment to wall hangings, bed coverings and accessories such as shams and pillows.

BACKGROUND-DESCRIPTION OF PRIOR ART

The prior art does not show the use of recycled sports jerseys for decorative jersey squares as shown in this invention. Printed logos have been used for sports quilts and blankets but not actual logos on jersey squares from recycled sports jerseys. Also, the use of logos on jersey squares from recycled sports jerseys together with the retention of the neck portion of the sports jerseys to identify the jersey squares as coming from actual sports jerseys has not been shown in the prior art.

OBJECTS AND ADVANTAGES

Objects and advantages of this method of making decorative jersey squares from recycled sports jerseys are:

(a) to make decorative jersey squares of reduced size that can be used for wall hangings, bed coverings and accessories.

(b) to make small jersey squares that have the sports logo while retaining much of the neck portion to identify the jersey squares as coming from a sports jersey.

(c) to use recycled sports jerseys that would otherwise be discarded.

DRAWING FIGURES

FIG. 3 is a perspective view of a wall hanging having attached jersey squares made according to the invention.

FIG. 4 is a perspective view of a pillow sham having two attached jersey squares.

FIG. 5 is a perspective view of a pillow having one attached jersey square.

DESCRIPTION-FIGS. 1 TO 5

Figure 1:
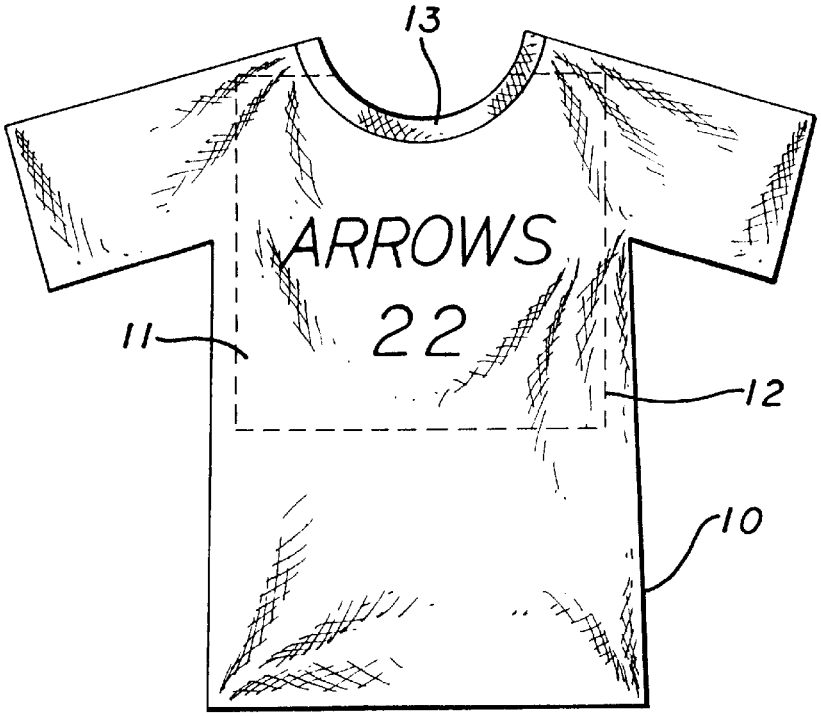
FIG. 1 is a view of a recycled sports jersey with dotted lines showing where the trimming cuts are made to retain the sports logo and the neck portion.
Figure 2:
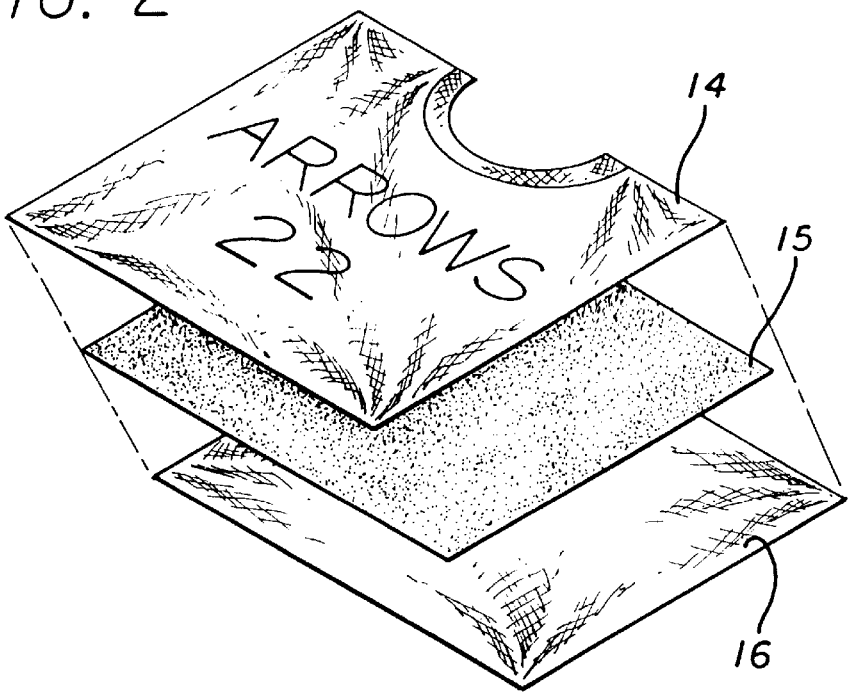
FIG. 2 is an exploded view showing the trimmed Jersey square, a heat-bonding adhesive material, and a cloth base.

FIG. 1 shows a sports jersey 10 having a sports logo 11. The sports jersey is trimmed along the dotted line 12. The dotted line 12 may extend on the sides to the extreme sides of the sports jersey 10. The top of the sports jersey 10 is cut along the top dotted line 12 or may be cut along the top on the sides of the neck 13 of the sports jersey 10. After trimming, the front and back portions of the sports jersey 10 are separated, and the portion of the sports jersey having the sports logo is retained for use. The trimming produces a substantially square-shaped jersey square, as shown in FIG. 2. The substantially square shape of the jersey squares 14 retains some or all of the neck portion 13 to identify the jersey squares as coming from a sports jersey. The reduced square shape also greatly increases the number of jersey squares that can be attached within a given area.

FIG. 2 shows the combination of the jersey square 14 together with an adhesive heat-bonding material 15 and a cloth base 16. The adhesive heat-bonding material 15 is placed over the cloth base 16 and the jersey square 14 is then placed over the adhesive heat-bonding material 15 and the cloth base 16. A hot iron is used to press the jersey square 14, the adhesive material 15, and the cloth base 16 together.

FIG. 3 shows the application of the jersey squares 14 to a wall hanging 17. The jersey squares 14 with the attached cloth bases 16 are assembled into one unit with horizontal cloth strips 18 and vertical cloth strips 19. The strips 18 and 19 serve to align and position the Jersey squares 14. The horizontal strips 18 may be sewn to the Jersey squares and cloth bases successively. The sides of the cloth strips are turned in with small margins before sewing. After the horizontal strips 18 have been sewn in place, the vertical strips 19 can be similarly sewn in place. The outer horizontal and vertical strips 18 and 19 may be folded in half lengthwise before sewing them to the jersey squares 14. A cloth backing the size of the wall hanging may be added to the wall hanging and the outer horizontal and vertical strips sewn to the cloth backing. Tab tops 20 are added to accommodate a support rod. The wall hangings can double as a throw. If used as a throw, the tab tops 20 may be eliminated.

The same sewing procedure can be applied to a bed covering. If a quilted bed covering is made, the outer horizontal and vertical strips can be sewn to a flannel or other cloth backing the size of the quilt. A batting layer can be added between the top surface of the quilt having the jersey squares and the cloth backing.

FIG. 4 shows a pillow sham 21 constructed according to the invention. Two jersey squares 14 are attached to the top surface of the sham 21.

FIG. 5 shows a small pillow 22 constructed according to the invention. In this embodiment of the invention, a sleeveless sports jersey has been used to make jersey square 14.

SUMMARY, RAMIFICATIONS, AND SCOPE

Accordingly, it will be seen that useful wall hangings and bed coverings and accessories such as shams and pillows may be made using the method of recycling sports jerseys as shown here. Different ways of sewing and heat bonding may be used together or alone to attach the jersey squares to the wall hangings and bed coverings and accessories. The individual cloth bases 16 may be replaced by a single larger cloth base and the jersey squares 14 sewn to the single cloth base. Other changes may be made within the scope of the invention, and the invention is not limited to specific details given in the above description.

I claim:

1. A method of recycling sports jerseys, each jersey having a top, a bottom, a pair of vertical sides, an upper neck portion, a front portion, and a back portion, said jerseys having logos on at least one of said front and back portions of said sports jerseys and using said front or said back portions with the logo for decorative jersey squares comprising the steps of trimming said pair of sides, said bottoms, and said tops of said sports jerseys to form approximate jersey squares having four edges while retaining at least a substantial portion of said neck portions of said sports jerseys, whereby said jersey squares may be identified as coming from sports jerseys.

2. A method of recycling sports jerseys according to claim 1, wherein a number of jersey squares are joined together to form a decorative surface by horizontal and vertical strips secured to said edges of said jersey squares.

3. A method of recycling sports jerseys according to claim 1, wherein said jersey squares are attached to cloth bases with an adhesive heat-bonding material.

* * * * *